United States Patent [19]

Oetiker

[11] Patent Number: 4,708,034

[45] Date of Patent: Nov. 24, 1987

[54] PINCER-LIKE TOOL

[76] Inventor: Hans Oetiker, Oberdorfstrasse 21, CH-8810 Horgen 2, Switzerland

[21] Appl. No.: 906,908

[22] Filed: Sep. 15, 1986

Related U.S. Application Data

[63] Continuation-in-part of Ser. No. 887,435, Jul. 21, 1986, which is a continuation-in-part of Ser. No. 777,340, Sep. 18, 1985.

[51] Int. Cl.[4] ..... B25B 27/00

[52] U.S. Cl. ..... 81/9.3

[58] Field of Search ..... 81/9.3, 415, 421, 422, 81/416, 423, 427.5, 341, 394; 72/409, 410; 29/243.5, 243.51, 243.56, 268; 76/114, DIG. 6

[56] References Cited

U.S. PATENT DOCUMENTS

| | | | |
|---|---|---|---|
| 993,052 | 5/1911 | Giffen | 81/394 |
| 1,578,438 | 3/1926 | Hintz . | |
| 2,614,304 | 10/1952 | Oetiker | 24/20 R |
| 3,082,498 | 3/1963 | Oetiker | 24/20 R |
| 3,257,874 | 6/1966 | Madeira | 81/9.3 |
| 3,261,244 | 7/1966 | Smoyak | 81/417 |
| 3,709,073 | 1/1973 | Kurtz | 76/114 |
| 4,162,640 | 7/1979 | Arnold | 81/9.3 |
| 4,492,004 | 1/1985 | Oetiker | 24/20 R |

FOREIGN PATENT DOCUMENTS

| | | | |
|---|---|---|---|
| 14604 | 5/1956 | Fed. Rep. of Germany | 76/114 |
| 17445 | of 1905 | United Kingdom | 81/9.3 |

*Primary Examiner*—Roscoe V. Parker
*Attorney, Agent, or Firm*—Paul M. Craig, Jr.

[57] ABSTRACT

A pincer-like tool for tightening clamps of the type provided with overlapping band portions each including an outwardly projecting embossment that extends generally in the circumferential direction of the clamp and offers by its opening an engaging surface disposed substantially transversely to the circumferential direction and located at the end of the embossment remote from the free end of the respective band portion. The pincer-like tool includes two main standard pincer-like members of punched-out steel plate material each having a head section and a shank-like connecting section, two handle members fastened to a corresponding one of the connecting sections, a pivotal connection pivotally connecting the two standard pincer-like members with each other in an area intermediate the head section and the connecting section, and two attachable standard parts forming nose-like end portions and adapted to be affixed to the head sections of the standard pincer-like members; the attachable standard parts forming the two nose-like end portions of the tool being each provided with two tips arranged symmetrically to a longitudinal center plane so that each nose-like end portion can be detachably attached to the head portion of the corresponding main standard part in two positions in which the two tips are successively brought into action are to thereby extend the useful life of the attachable part.

18 Claims, 15 Drawing Figures

FIG. 5
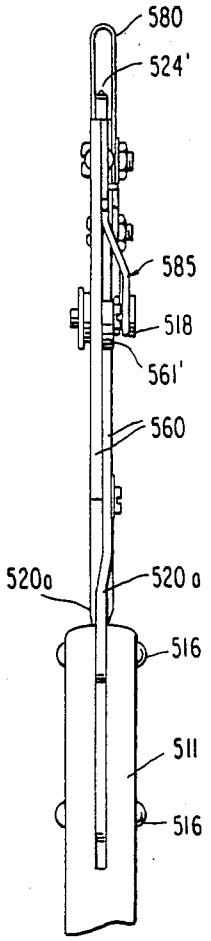
FIG. 4
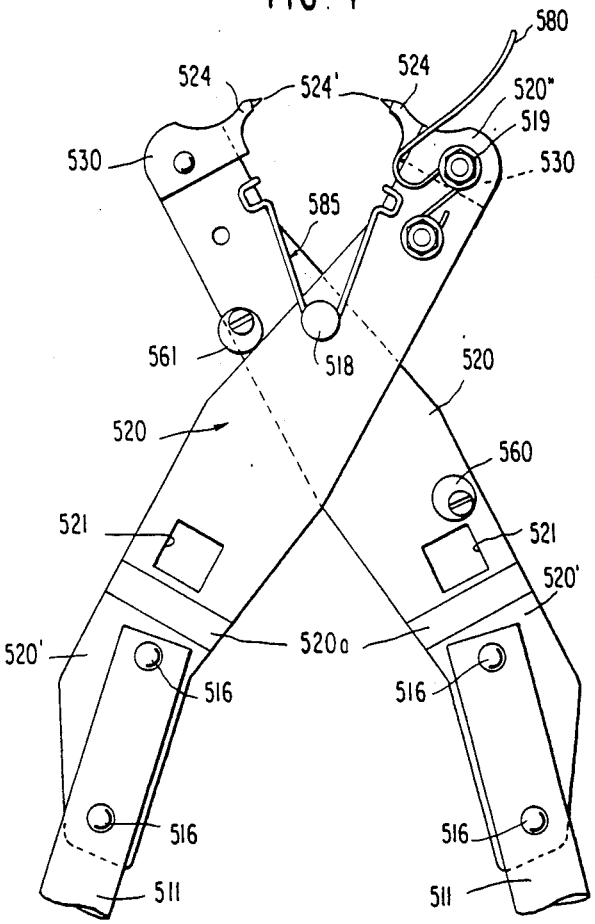
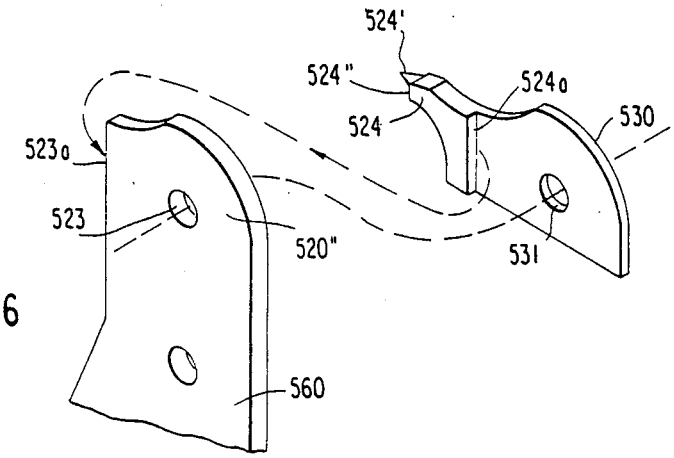
FIG. 6

FIG. 10
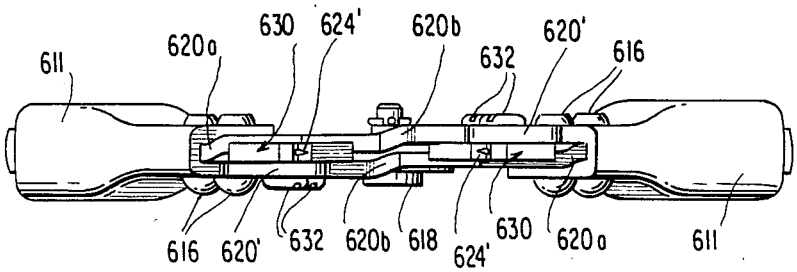
FIG. 14
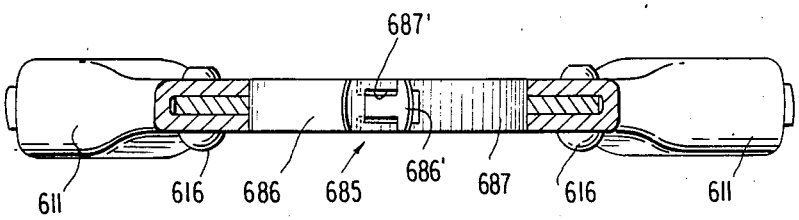
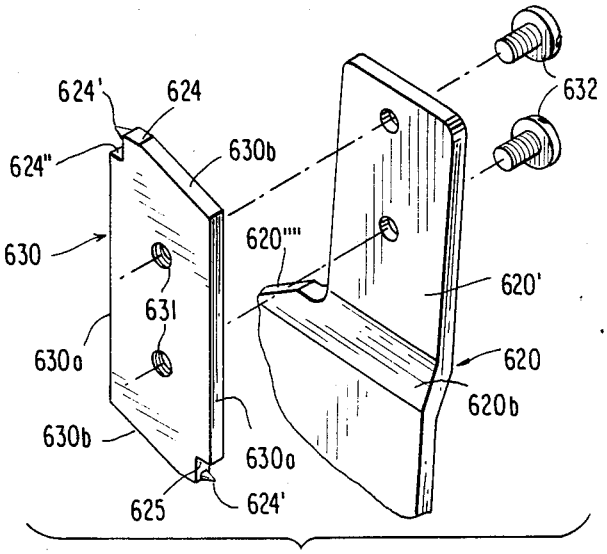
FIG. 15

PINCER-LIKE TOOL

This application is a continuation-in-part application of my co-pending application Ser. No. 887,435, entitled "Pincer-Like Tool" filed July 21, 1986 (D/21449), which is a continuation-in-part application of my co-pending application Ser. No. 777,340, entitled "Pincer-Like Tool", filed Sept. 18, 1985.

The present invention relates to a pincer-like tool for tightening clamps with the use of standard parts stamped-out from steel plate material.

Conventional pincers with two short handles and grasping jaws working on a pivotal have been used heretofore for plastically deforming a so-called "Oetiker" ear in clamps of the type described, for example, in my U.S. Pat. Nos. 2,614,304 and 3,082,498. These types of pincers, made by forging, are relatively costly and likely to break under the application of very high forces necessary for reliably tightening certain clamps. Furthermore, these prior art pincers entail the disadvantage that the clamp might be destroyed during installation if the person incorrectly places the pincers over the ear so as to contact only a part of the ear with the jaws, thereby destroying the clamp.

Special tools were required heretofore to install earless clamps of the type disclosed, for example, in my prior U.S. Pat. No. 4,492,004. The pincer-like tools for tightening such clamps had to be specially made to provide small projecting tips at the jaws of the pincers capable of fitting into the circumferentially extending openings formed by outwardly extending embossments in the clamp. The manufacturing costs for such pincer-like tools were very high.

Moreover, it is frequently necessary to tighten the clamps with predetermined torque. Though so-called torquing keys are normally available in most repair shops, they could not be used with the prior art pincer-like tools.

Accordingly, it is the principal object of the present invention to provide a pincer-like tool for earless clamps of the type described in my U.S. Pat. No. 4,492,004 which can be manufactured in a simple and relatively inexpensive manner and whose parts can be easily assembled and reused in case of wear by merely changing the position of the nose-like parts as attached to the main standard parts.

The underlying problems are solved according to the present invention in that the pincer-like tool is assembled of standard parts, stamped-out from steel plate material of such shape and configuration that they can be readily assembled. Additionally, to permit greater use of the same parts, when non-usable due to wear, the present invention proposes to so construct the parts of the tool forming the nose-like end portions that the latter can be attached to the main standard parts in two symmetrical positions. The parts forming the nose-like end portions which include the tips adapted to engage in the circumferentially extending opening formed by outwardly extending embossments in the earless clamps, are thereby constructed symmetrically with respect to a center plane so that these parts can be attached to the main standard parts in two positions in which the tips provided at opposite ends of these parts are alternately usable.

Wrenches of laminated construction are known in the prior art from U.S. Pat. No. 3,709,073. However, the laminated wrench construction of this patent is for purposes of increasing strength and durability of the tool in which the various parts are bonded or welded together along their peripheral edges. Apart from the fact that a wrench does not include pivotally connected parts, the tool of this patent is for entirely different purposes and concerned with different problems.

The German Patent Application M No. 14 604 Ib/7c to Mueller et al. discloses a method for manufacturing pliers or similar tools which are assembled of a number of parts cut out of steel plating. However, the tool disclosed in this patent is not for tightening clamps and because of its configuration would be unsuited to close earless clamps of the type with which this invention is concerned.

If the standard stamped-out parts are assembled in accordance with this invention into a pincer-like tool for tightening earless clamps, sufficient guidance is provided according to still another feature of the present invention to confine the jaws to purely pivotal movement notwithstanding the relatively large travel of the jaws of the pincer-like tool during the closing operation.

To achieve closing pressures of more than 1,000 Kg with the use of average human strength, the pincer-like tools of my invention can be provided with tubular extensions which, for example, can be pulled out so as to increase the leverage attainable with the tool. By increasing the leverage of the handle members, clamps made of heavier material can be fastened with predetermined higher pressures.

Furthermore, according to another feature of the present invention, conventionally available torque keys can be attached to the pincer-like tool of my invention where it is necessary to fasten the clamp with a predetermined pressure. For example, if the clamps are installed at the assembly line with predetermined pressure by the use of pneumatic pincers to effect a constant qualitatively perfect seal, the same installation can be duplicated in garages or other shops with the once-predetermined jaw pressure as had been used for the original installation at the assembly line. This assures that these installations have always been made with a very definite jaw pressure. This eliminates possible non-tightness due to insufficient jaw pressure or excessive deformation of the hose material in case of excessive jaw pressure. This is particularly important when clamping harder materials such as, for example, Hytrel. Conventionally available torque keys, used for fastening cylinder heads or other screws which need to be tightened with a certain torque, can then be used also for tightening the clamps with predetermined jaw pressure.

According to still another feature of the present invention, a spring is provided on the pincer head used for fastening stepless earless clamps. This spring assures depressing the clamp end when installing an earless clamp so as to engage with the locking and support hooks. The tool then performs a function which otherwise would have to be performed by the fingers of the installer. The spring can thereby be easily matched to every size of the clamp to press down the outer end of the clamping band.

In a pincer-like tool consisting only of two unitary standard parts stamped out from steel plate material which include each the jaw portion and handle portion and which are pivotally interconnected with each other, it is necessary to provide two cranked or offset portions in each standard part to permit the pivotal connection with the jaw portions aligned.

According to the present invention, the number of cranked or offset portions can be reduced by utilizing two standard flat parts in conjunction with two standard jaw members which are so constructed and arranged that they can be assembled and fixedly held in place by the use of a single screw. Apart from extreme simplicity and low cost, it permits a saving in material as the jaw tips which are more likely to break, can be readily exchanged in case of need. Thus, in case of breakage at the tip of the jaw of the tool, the main standard part which is made of high grade steel can be re-used after the tip is interchanged.

In another preferred embodiment of the present invention, the attachable part stamped out from high grade steel plate material which forms the nose-like end portion of the pincer jaws are provided with two tips arranged symmetrically with respect to a center longitudinal plane so that this attachable standard part can be attached to the head portion of the main standard part in two positions in which the two tips come into play. This permits use of the same attachable part to provide in effect two nose-like end portions each with a tip so as to double the length of life of the attachable part, considering that the tips are most likely to wear out first. This offers to the user of the tool the significant advantage that in case the tip of the tool breaks, it is only necessary to unscrew the attachable part, then reverse the latter's position by 180° and again screw on the attachable part in the new position. Additionally, as the attachable standard part is a stamped-out part which, with the exception of the tips, is of uniform thickness, manufacture thereof is also simplified as it does not involve any milling operations and/or other machining operations to form a positioning shoulder.

To avoid damage to the nose-like tips of the pincer-like tool used for tightening earless clamps, a preferably adjustable stop is provided according to the present invention to limit the closing of the pincer-like tool. Furthermore, to limit the opening of such pincer-like tool, in order to facilitate installation of the clamp, another, preferably adjustable stop is provided according to the present invention which limits the maximum opening of the jaws of the pincer-like tool. These stops are conveniently in the form of eccentric disks which can be readily adjusted to the needs of a given situation.

These and other objects, features and advantages of the present invention will become more apparent from the following description when taken in connection with the accompanying drawing which shows, for purposes of illustration only, several embodiments in accordance with the present invention, and wherein:

FIG. 4 is a partial elevational view of a modified embodiment of a pincer-like tool in accordance with the present invention for tightening earless clamps, similar to FIGS. 1–3, but provided with detachable nose-like jaw members;

FIG. 5 is a partial side elevational view of the pincer-like tool of FIG. 4;

FIG. 6 is a perspective view, on an enlarged scale illustrating the assembly of the nose-like jaw member onto the standard part in accordance with the present invention;

FIG. 10 is a top plan view of FIG. 7;

FIG. 14 is a cross-sectional view taken along line XIV—XIV of FIG. 7; and FIG. 15 is a perspective view, broken away, and illustrating the assembly of the standard attachment part to the main standard part in accordance with the present invention.

Figure 3:
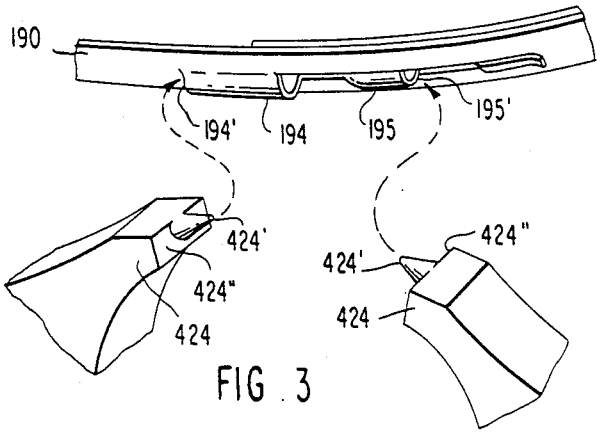
FIG. 3 is a partial perspective view, on an enlarged scale, of the nose-like end portions and tips of the pincer-like tool of FIGS. 1 and 2.

Referring now to the drawing wherein like reference numerals are used throughout the various views to designate like parts, the pincer-like tool generally designated by reference numeral 410 is intended for installing an earless clamp of the type disclosed in my U.S. Pat. No. 4,492,004. The pincer-like tool of this invention utilizes only two main standard parts 420 so that each main standard part 420, which is connected at its shank-like connecting portion 420' with the handle member 411 in any known manner, is provided with two offsets **420*a* and 420*b* to permit a pivotal connection by any conventional means while the nose-like end portions 424 including the tips 424', which are formed integrally with the head portions 420'' of the main standard parts 420, travel in the same plane. The handle members 411 are, for example, of tubular stock material provided at their upper ends with slots in which the lower ends of the main standard parts are secured, for instance, by rivets 416. The tips 424' which are intended to engage in the circumferentially extending opening in the embossments 194 and 195 (FIG. 3) of an earless clamp 190, are of at least approximately complementary shape to the embossments 194 and 195. Since these embossments 194 and 195 are of approximately semi-circular shape, the tips 424' are also at least of approximately semi-circular shape along the outer surface of the tapering configuration thereof. Moreover, the tips 424' are so located in relation to the end face of the nose-like end portion that an abutment surface in the form of shoulder 424'' remains for engagement with the engaging surfaces 194' and 195' of the embossments. A spring generally designated by reference numeral 486 which includes end portions 487 and 488, suitably engaging with the upper portion of the main standard parts 420, normally urges the pincer-like tool of FIGS. 1 and 2 in the jaw-opening direction. The two main standard parts 420 are pivotally connected with each other in their center area by means of a pivot pin 418** suitably held in place by any conventional means, for example, by cotter pins (not shown) as described in my two aforementioned copending applications, the subject matter of which is incorporated herein by reference.

Figure 1:
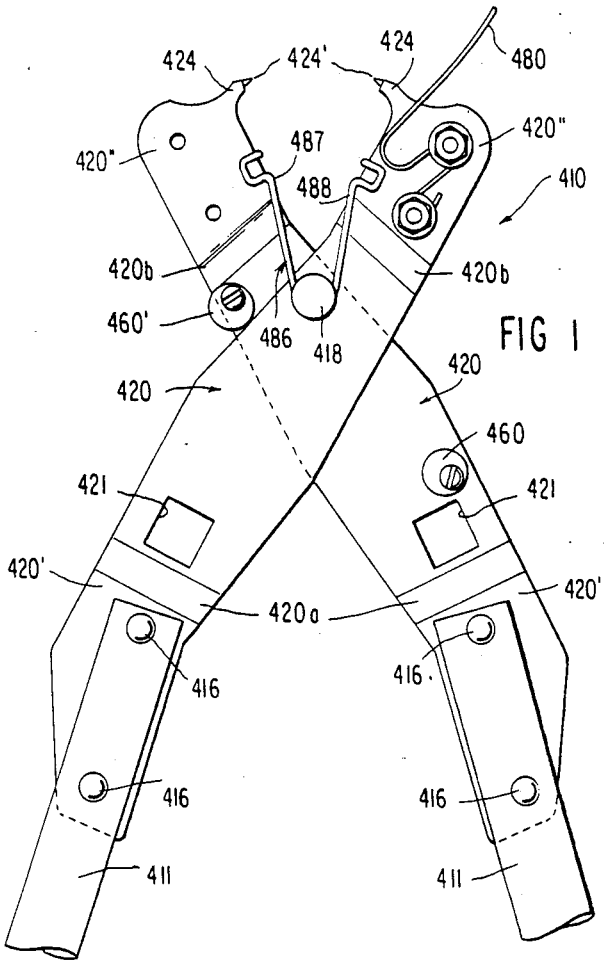
FIG. 1 is a partial elevational view of a pincer-like tool for tightening earless clamps utilizing two standard parts stamped-out from steel plate material which are each provided with two cranked portions.

An eccentrically mounted disk 460 is provided on the main standard part 420 above the right square opening 421, as viewed in FIG. 1, to limit the closing movement of the pincer-like tool in order to protect the tips 424' from damage. For ease of installation, it is also convenient to provide a further eccentrically mounted disk 460' which limits the opening travel of the pincer-like tool so as to facilitate installation of the band clamp. The square openings 421 in the shank-like portions 420' are for the installation of torquing keys of conventional type so as to permit closing of the clamp with predetermined torque, as also disclosed in my aforementioned applications. Additionally, the pincer-like tool 410 is provided with a spring 480 of suitable shape which is intended to depress the outer band portion of the clamp over the inner band portion to assist, without the need to use a hand, in the engagement of the guide and support hooks provided on the inner band portion in the corresponding openings provided in the outer band portion. The spring 480 may thereby be made of a suitable material to permit the spring to be bent into appropriate shape conforming to the size of the clamp to be installed.

Figure 2:
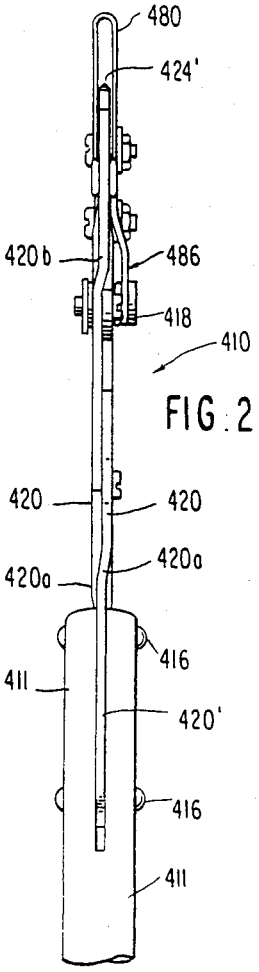
FIG. 2 is a side elevational view of the pincer-like tool of FIG. 1.

FIGS. 4 through 6 illustrate a modified embodiment in accordance with the present invention in which the offset **420*b* of the embodiment of FIGS. 1 and 2 can be eliminated. Parts corresponding to those of the embodiment of FIGS. 1 through 3 are designated in the embodiment of FIGS. 4 through 6 by corresponding reference numerals of the 500 series. Differing from the embodiment of FIGS. 1–3, the main standard parts 520 are provided only with one offset 520*a* for connection with the corresponding handle members 511. This is made possible by the use of separate attachable standard parts 530 whose nose-like end portions 524 are thicker than the main portion of the attachable standard part 530 provided with the hole 531 so as to form a flat shoulder 524*a* in the transition between the two thicknesses which abuts at the flat end face 523*a* of the head portion 520'' of the main standard part 520. The parts are thereby so dimensioned that when the parts 530 and 520 are connected together by the use of a threaded connection engaging in holes 523 and 531 (FIG. 6), the shoulder 524*a* engages the end surface 523*a*. A sturdy fixed connection is achievable thereby with the use of only a single threaded connection. As the stamped-out parts are normally made from high-grade steel plate material, and as the tips 524' are most likely to wear out first, it is only necessary to replace the part 530 with a new part in order to be able to reuse the remaining parts of the pincer-like tool. The eccentrically mounted stop disks are designated in this embodiment by reference numerals 560 and 561**.

Figure 7:
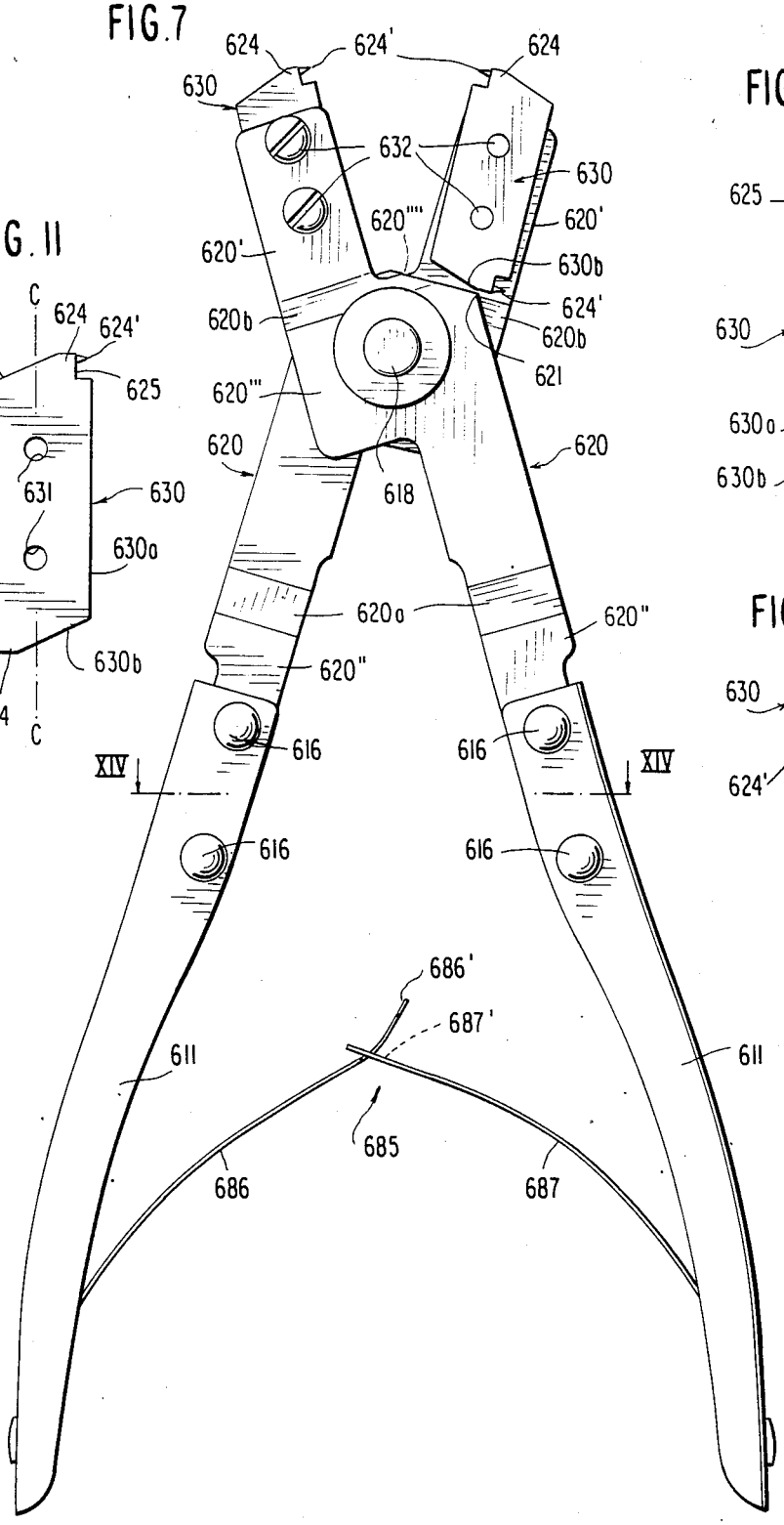
FIG. 7 is an elevational view of still another embodiment of a pincer-like tool for tightening earless clamps, which, according to the present invention, utilizes two main standard parts stamped-out from steel plate material and two reversible and attachable parts provided with two symmetrically located tips, with the pincer-like tool in the open position.
Figure 11:
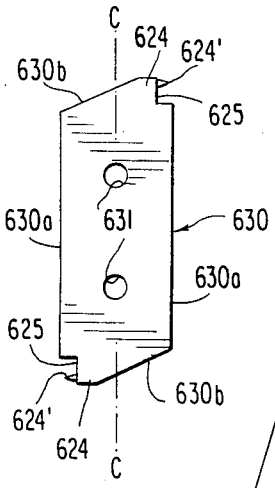
FIG. 11 is a front elevational view of the standard attachment part in accordance with the present invention.
Figure 12:
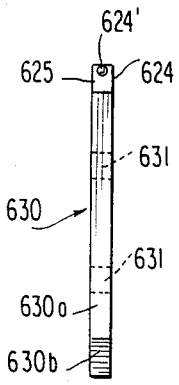
FIG. 12 is a side elevational view of the attachment part of FIG. 10.
Figure 13:
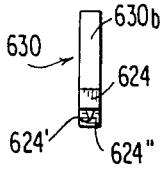
FIG. 13 is a top plan view on the attachment part of FIG. 11.
Figure 8:
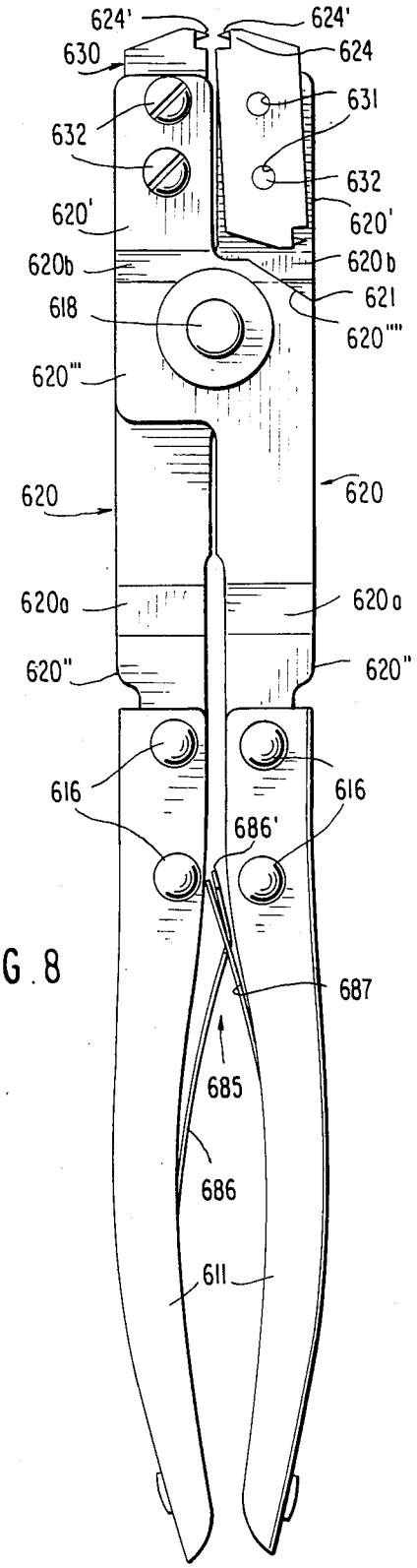
FIG. 8 is an elevational view, similar to FIG. 7, showing the pincer-like tool in the closed position.
Figure 9:
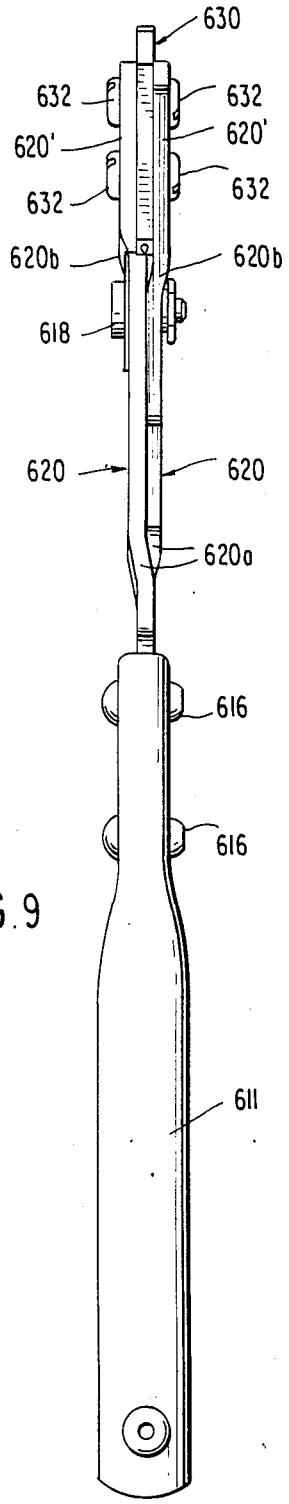
FIG. 9 is a side elevational view of FIG. 7.

The embodiment of FIGS. 7 through 14 differs from the embodiment of FIGS. 4 through 6 in the following respects. The two main standard parts generally designated by reference numeral 620 whose general shape can be seen best in FIGS. 7 and 8, are provided each with two offsets or cranked portions **620*a* and 620*b*. The main standard parts 620 are connected at the flat shank-like connecting sections thereof, for example, by means of rivets 616 with the handle members 611 which within the area of the shank-like connecting portions are of relatively narrow, substantially U-shaped cross section that widens into a U-shaped cross section toward the free ends of the handle members 611 (FIG. 9). Additionally, the tips 624' are formed-on at the end-like nose portions 624 of the separate attachment parts generally designated by reference numeral 630 which are adapted to be detachable secured at the head portion of each main standard part 620. For that purpose, the attachment parts 630 are provided each with two threaded holes 631 for threadably receiving the assembly screws 632. Each standard attachment part 630 is thereby provided with two tips 624' arranged symmetrically with respect to the center longitudinal plane C—C (FIG. 11). The tips 624' are thereby preferably constructed like the tips 424' and 524' providing again an abutment surface 624'' (FIG. 13). As can be seen from FIG. 11, each attachment part 630 which is of constant thickness, stamped out from high grade steel plate material, is thereby of substantially rectangular configuration having two parallel longitudinal sides 630*a* and two parallel end sides 630*b* which form an angle somewhat greater than 90° with the longitudinal sides. The nose-like end portions 624 with the tips 624' thereby face in opposite directions as viewed in FIG. 11 with a groove-like undercut 625 underneath each tip 624'**.

The head portion 620' and the shank-like connecting portions 620'' are thereby of approximately the same width and extend parallel to one another, interconnected by a transversely extending enlarged center area 620'''. The right angle relationship between the outer surfaces of the portions 620', 620''' and 620'' is changed only along the bevelled surface 620'''' so as to provide a stop of the pincer-like tool in the opening direction by abutment of the corner 621 at the surface **630*b* of the attachment part 630. The two main standard parts 620 are thereby pivotally connected with each other by means of a pivot member 618** held in place by any conventional means, for example, by two cotter pins as disclosed in the aforementioned co-pending applications, possibly by the use of washers or the like.

A spring generally designated by reference numeral 685 and consisting of two spring-like band members 686 and 687 thereby urges the pincer-like tool in the opening direction as the handle members 611 are moved toward each other. The band-like spring members 686 and 687 are connected at their free ends to the handle members 611 and cooperate with each other by engagement of a mushroom-like head portion at the free end of the band part 686 engaging in a slot 687' provided in the free end of the other band member 687. The enlarged head portion 686' can thereby be extended through the slot 687' by twisting it to an approximately right angle position. The pincer-like tool of FIGS. 7 through 14 offers the advantage that each attachment part 630 includes two tips 624' so that in case of wear or breakage of a tip, it is only necessary to unscrew the attachment part 630 by loosening the screws 632 and then re-attach it in reverse position so that the non-worn tip comes into use. This not only lengthens the useful life of the standard stamped-out attachment part but eliminates machining operations such as required to realize the shoulder **524*a* of the embodiment of FIGS. 4 through 6. Furthermore, separate stop members become unnecessary since this function is taken over by the corner 621 in each main standard part engaging against the end surface 630*b*** of the attachment part.

If so desired, the shank-like connecting portions may again be provided with square openings such as openings 421 and 521 for the attachment of torquing keys. Additionally, to increase the leverage, the handle members 411, 511 and 611 may be made of circular stock so that tubular members suitably held by detents can be mounted over the same in such a manner that the tubular members can be displaced into their extended position to increase the lever length.

Additionally, the embodiment of FIGS. 7 through 14 may also be provided with a spring similar to springs 480 and 580 for the same purposes, i.e., to assist holding down the outer band portion so as to bring about automatic engagement of the hooks on the inner band portion in the apertures provided in the outer band portion of the clamp.

The pincer-like tool of the present invention offers numerous advantages. First, it permits a rational and relatively inexpensive manufacture of pincer-like tools utilizing interchangeable standard parts stamped-out of steel material, especially high-grade steel. It permits the installation of earless clamps with forces that can be accurately controlled, if so desired, by the installation of auxiliary devices such as a torquing key. The same pincer-like members can also be connected to pneumatic actuating devices to provide the requisite high, accurately controlled pressure for the jaws. Notwithstanding the simplicity of such pincer-like tool, the parts thereof are completely satisfactorily guided in their pivotal movement. Moreover, the useful life of the most sensitive part can be effectively increased. Finally, the present invention also permits a rational repair of pincer-like tools for installing earless clamps which is cost-saving and simple.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A pincer-like tool for tightening clamps of the type provided with overlapping band portions each including an outwardly projecting embossment means that extends generally in the circumferential direction of the clamp and offers by its opening an engaging surface disposed substantially transversely to the circumferential direction and located at the end of the embossment means remote from the free end of the respective band portion, comprising two main standard pincer-like members of punched-out steel plate material each having a head section and a shank-like connecting section, two handle members fastened to corresponding connecting sections, means pivotally connecting the two standard pincer-like members with each other in an area intermediate the head section and the connecting section, and further means including an attachable stamped-out part attached to said head section to thereby provide by said attachable part a nose-like end portion detachably secured at each head section of the standard pincer-like members, the two nose-like end portions being so arranged as to approach one another when the tool is actuated by displacing the handle members toward one another, and each attachable part forming a nose-like end portion being provided with two tips projecting outwardly from its end faces and arranged symmetrically with respect to a longitudinal center plane in such a manner that said end portions can be installed on the head section in two positions to selectively bring into use one tip and, after wear thereof, the other tip so as to extend the useful life of each attachable part.

2. A pincer-like tool according to claim 1, wherein said tips are of such a shape as to fit into the embossment means.

3. A pincer-like tool according to claim 2, wherein each tip is of an external configuration at least approximately complementary to the internal configuration of the embossment means.

4. A pincer-like tool according to claim 3, wherein each tip is of at least approximately partially cylindrical shape.

5. A pincer-like tool according to claim 4, wherein each tip tapers in the direction toward its free end.

6. A pincer-like tool according to claim 5, wherein each tip is at least approximately part conically shaped.

7. A pincer-like tool according to claim 6, wherein the end faces of the nose-like end portions are provided with abutment surfaces on both sides of the tips.

8. A pincer-like tool according to claim 1, further comprising limit means in said tool for limiting the closing movement of the nose-like end portions to protect said tips.

9. A pincer-like tool according to claim 8, further comprising limit means in said tool for limiting the opening movement thereof.

10. A pincer-like tool according to claim 9, wherein said last-mentioned limit means are formed in effect by engagement of the center area of the main standard part at the lower end face of the attachable part attached to the other standard main part.

11. A pincer-like tool according to claim 1, further comprising a spring member fastened to and extending outwardly from said head portion, said spring member being adaptable in its shape to engage with the outer band portion of the clamp.

12. A pincer-like tool according to claim 1, further comprising spring means urging the pincer-like members in their opening direction.

13. A pincer-like tool according to claim 1, wherein only two main standard stamped-out parts and two attachable standard stamped-out parts are used.

14. A pincer-like tool according to claim 13, wherein the nose-like end portions which are constituted by separate parts stamped-out from steel plate material, include two holes for the detachable connection with the main standard parts.

15. A pincer-like tool according to claim 1, wherein each tip tapers in the direction toward its free end.

16. A pincer-like tool according to claim 15, wherein said tips are at least approximately part conically shaped.

17. A pincer-like tool according to claim 1, wherein the end faces of the nose-like end portions are provided with abutment surfaces on both sides of the tip.

18. A pincer-like tool according to claim 1, wherein the nose-like end portions which are constituted by separate parts stamped-out from steel plate material, include two holes for the detachable connection with the main standard parts.

* * * * *